United States Patent [19]

Connelly et al.

[11] 4,436,289

[45] Mar. 13, 1984

[54] METHOD AND APPARATUS FOR CONTROLLING THE ATMOSPHERE IN A CARBURIZING FURNACE UTILIZING A CASCADED VALVING SYSTEM

[75] Inventors: John J. Connelly, Naperville; Raymond A. Cellitti, Hinsdale, both of Ill.

[73] Assignee: International Harvester Co., Chicago, Ill.

[21] Appl. No.: 303,289

[22] Filed: Sep. 17, 1981

[51] Int. Cl.[3] ..... C21B 7/24

[52] U.S. Cl. ..... 266/80; 266/83; 266/85; 266/88; 266/251

[58] Field of Search ..... 266/251, 252, 80, 81, 266/82, 83, 85, 87, 88

[56] References Cited

U.S. PATENT DOCUMENTS

| | | | |
|---|---|---|---|
| 2,449,760 | 9/1948 | Bedford | 266/252 |
| 2,664,283 | 12/1953 | Hess et al. | 266/83 |
| 2,754,104 | 7/1956 | Hess | 266/252 |
| 2,872,175 | 3/1959 | Guenzi | 266/252 |
| 3,128,323 | 4/1964 | Davis | 266/251 |
| 3,565,606 | 2/1971 | Carlson et al. | 75/60 |
| 3,999,046 | 12/1976 | Porter | 235/151.1 |
| 4,003,803 | 1/1977 | Schmidt-Balve | 202/262 |
| 4,238,122 | 12/1980 | Snyder et al. | 266/251 |

*Primary Examiner*—John P. Sheehan

*Attorney, Agent, or Firm*—F. David AuBuchon

[57] ABSTRACT

An automatic control for a multi-zone push type carburizing furnace capable of controlling the flow of either an endothermic gas atmosphere or a nitrogen methanol atmosphere at both high and low flow rates and during normal and suspend carburizing utilizes cascaded multi-stage valving to assure good separation of the atmospheres in adjacent zones. The first stage of the cascaded multi-stage valving controls the total gas flow, and the second stage routes the gas to individual zones of the furnace.

20 Claims, 1 Drawing Figure

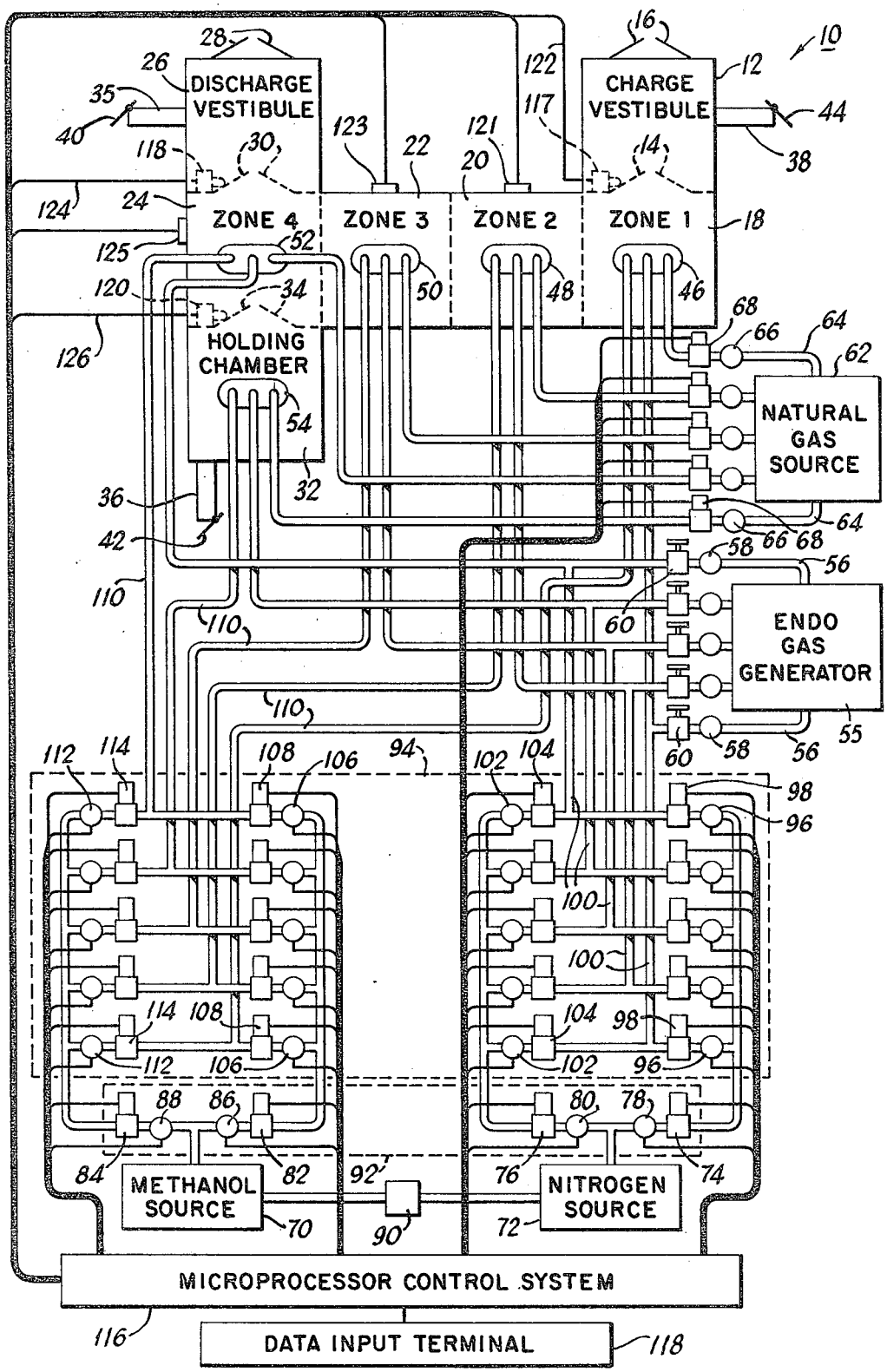
DISCHARGE VESTIBULE
CHARGE VESTIBULE
ZONE 4
ZONE 3
ZONE 2
ZONE 1
HOLDING CHAMBER
NATURAL GAS SOURCE
ENDO GAS GENERATOR
METHANOL SOURCE
NITROGEN SOURCE
MICROPROCESSOR CONTROL SYSTEM
DATA INPUT TERMINAL

METHOD AND APPARATUS FOR CONTROLLING THE ATMOSPHERE IN A CARBURIZING FURNACE UTILIZING A CASCADED VALVING SYSTEM

BACKGROUND OF THE INVENTION

1. Field of the Invention

This invention relates generally to carburizing methods and apparatus, and more particularly, to a control system for a multi-zone carburizing furnace of the push type that is capable of normal and suspend carburizing and capable of carburizing utilizing either an endothermic gas process or a nitrogen methanol process.

2. Description of the Prior Art

Multi-zone push type carburizing furnaces of are known. In such furnaces, trays of parts, typically fabricated from ferrous metals, are placed in a tray and "pushed" into a first zone of the carburizing furnace. The trays are kept in the first zone for a predetermined time, during which time a predetermined amount of carburizing takes place. After the expiration of the predetermined length of time, a second tray is pushed into the first zone, thereby advancing the first tray. The process is repeated until the first tray, and the trays subsequently pushed in are advanced through the various zones of the carburizing furnace and discharged at the opposite end. In such carburizing furnaces, the temperatures and the atmospheres of the various zones must be carefully controlled to maintain the desired temperature and carbon potential required for the particular carburizing being done.

In one type of prior art carburizing furnace, the temperature in each of the zones is controlled thermostatically with the thermostat which is either manually set or remotely set by means of some sort of control system. In such a furnace, the atmosphere is generally an endothermic gas atmosphere, which is generated by an endothermic gas generator. The endothermic gas is usually enriched by the addition of methane ($CH_4$) or natural gas. In a typical endothermic gas generator, the endothermic gas is made by cracking methane with air to provide an endothermic gas composition of approximately 40% nitrogen, 40% hydrogen, 20% carbon monoxide, 0.1 to 0.5% carbon dioxide and 0.1 to 0.5 water vapor.

In an alternative method of generating the carburizing carrier gas, nitrogen is reacted with methanol to provide the carrier gas in the following equation:

$$2N_2+CH_3OH \rightarrow CO+2H_2+2N_2$$

The above reaction provides a gas having a composition of approximately 40% nitrogen, 40% hydrogen and 20% carbon monoxide. This gas is also enriched by the addition of methane ($CH_4$) or natural gas to provide the carburizing atmosphere.

However, push type carburizing furnaces operating in the normal carburizing mode have a basic disadvantage. This disadvantage relates to the length of time required for each tray to pass through the furnace, and results in a long start up time and a long shut down time for the carburizing furnace. For example, it may take on the order of four hours for a tray of parts to pass completely through the furnace from the first zone through the last. Consequently, when the carburizing operation is to be shut down for a period of time, such as a holiday period or a weekend, the operator cannot load any parts into the carburizing furnace for the last four hours of the shift prior to the shut down. Instead, empty trays are loaded into the carburizing furnace in order to push the last of the parts through the furnace before shut down. Production is lost during that four hour period. In addition, because of the large thermal mass of the furnace, several hours are required to bring the furnace up to temperature following the end of the weekend or the holiday period. Moreover, once the furnace has reached operating temperature, because of the time required for the parts to pass through the furnace, another four hours or so must elapse before the first parts are expelled from the furnace. Consequently, full production is obtained only during Tuesday through Thursday of a normal work week.

In an effort to overcome the disadvantages of the normal carburizing operation, a suspend carburizing operation has been developed. In a suspend carburizing operation, full trays are pushed through the furnace until just shortly before the end of the last shift prior to the weekend or holiday period, and the furnace is switched into a suspend mode of operation for the weekend. In the suspend mode of operation, the temperature of the furnace is reduced, typically from a normal carburizing temperature of on the order of 1700° F. to a suspend carburizing temperature of on the order of approximately 1200° F. to 1300° F. During the suspend carburizing cycle, the carburizing gases are expelled, and the furnace is filled with an inert atmosphere, usually nitrogen. During this suspended mode of operation, the carburizing process is suspended; however, carburizing may readily be resumed by replacing the inert gas atmosphere with a carburizing atmosphere and raising the temperature to the normal carburizing temperature. The advantage of suspend carburizing over normal carburizing is that production can continue until almost the end of the last shift prior to the suspension. In addition, since the furnace is not completely cooled, the time required to bring the furnace up to temperature is substantially shorter, and more importantly, since the furnace is now full of parts that have been carburized to various degrees, the output of the carburized parts being almost immediately after normal carburizing temperature has been reached.

However, one of the disadvantages of suspend carburizing is that during the transition from the carburizing to the suspend mode, the composition of the carburizing atmosphere must be changed to reflect the change in the carbon potential as a function of temperature during the ramp down of temperature to the suspend mode. Moreover, the amount of carburizing that results during the ramp down of temperature, as well as the carburizing that occurs during the ramp up in temperature following the suspend period must be calculated, and the remainder of the carburizing process must be adjusted to account for this carburizing that took place during the ramp up cycle and ramp down cycle. Thus, in addition to accurate temperature control, the flow as well as the composition of the carburizing atmosphere must be accurately controlled. These requirements make it advantageous to utilize a computer controlled control system to control the carburizing process particularly during the transition from normal to suspend carburizing and vice versa.

Although it is possible to control the temperatures of the various zones in a carburizing furnace by means of a microprocessor and appropriate temperature sensing equipment, the control of the carburizing atmosphere is much more difficult, particularly when an endothermic gas generator is used. One reason for the difficulty in controlling the composition of the atmosphere is that an endothermic gas generator is a device that generates the endothermic gas in a process that operates at a substantially constant volume, temperature and input gas flow, and serves to provide an endothermic gas having substantially constant properties. Any attempt to change the characteristics of the endothermic output gas requires a change in the reaction occurring in the endothermic gas generator. Unfortunately, such changes are not made readily, and the results of such changes are unpredictable.

The problems associated with the control of the carburizing atmosphere are largely alleviated by utilizing the nitrogen-methanol method of generating the carrier gas. In the nitrogen-methanol method of generating the carrier gas, the reaction that forms the carrier gas occurs inside the carburizing furnace, rather than in an external generator. Consequently, the composition of the carrier gas can be readily controlled by simply controlling the amount of nitrogen (in gas form) and methanol (in liquid form) that is injected into the furnace. Unfortunately, a drawback of the nitrogen-methanol process is cost, and the increased cost of generating the carrier gas by the nitrogen-methanol process nullifies much of the cost advantages obtained from the substantially continuous production that can be obtained from a suspend carburizing process.

Accordingly, it is an object of the present invention to provide an improved carburizing method and apparatus that overcomes many of the disadvantages of the prior art.

It is another object of the present invention to provide a new carburizing method and apparatus that substantially reduces the cost of carburizing.

It is yet another object of the present invention to provide an improved carburizing method and apparatus that is capable of doing both normal and suspend carburizing which generates the carrier gas with either an endothermic gas generator or by the nitrogen-methanol process in order to optimize carburizing efficiency.

It is still another object of the present invention to reduce the cost of producing carrier gas by the nitrogen-methanol process through the use of high and low carrier gas flow rates during various stages of the carburizing process.

It is yet another object of the present invention to improve the control of the composition of the carrier gas produced by the nitrogen-methanol method, particularly during low flow rates, by using a multi-stage cascaded valving system.

DETAILED DESCRIPTION OF THE DRAWING

These and other objects and advantages of the present invention will become readily apparent upon consideration of the following detailed description and attached drawing, wherein:

The single FIGURE is a schematic diagram of the system according to the present invention.

DETAILED DESCRIPTION OF THE PREFERRED EMBODIMENT

Referring now to the FIG. 1, there is shown a top view of a typical carburizing furnace, generally designated by the reference numeral 10. The furnace 10 includes a charge vestibule 12 having two sets of doors 14 and 16 that is used to receive the trays of parts prior to their being pushed into the furnace itself. The illustrated furnace 10 also includes four zones 18, 20, 22 and 24, also captioned Zone 1, Zone 2, Zone 3 and Zone 4. Although four zones are illustrated, any number of zones may be used depending on the complexity of the particular carburizing being done. In addition, the furnace 10 has a discharge vestibule 26 having two pairs of doors 28 and 30 that receives the carburized parts ejected from the furnace. A holding chamber 32 having a pair of doors 34 serves as a fifth zone in order to provide further carburizing or quenching of parts in processes requiring more processing than can be provided by the normal four zones. Three effluent discharge pipes 35, 36 and 38 are provided at the discharge vestibule 26, the holding chamber 32 and the charge vestibule 12, respectively, are coupled to an exhaust system (not shown) and serve to remove waste gases from the furnace. Since it is important to maintain a positive pressure within the furnace 10, each of the discharge pipes 34, 36 and 38 has a resiliently biased valve which may be, for example, a flapper plate such as one of the flapper plates 40, 42 and 44 which opens varying amounts as a function of the carrier gas flow and pressure in the furnace 10 in order to assure that a positive pressure is always maintained within the furnace 10 even at low flow rates of the carrier gas. Five inlet pipes 46, 48, 50, 52 and 54 are provided in the respective zones 18, 20, 22, 24 and the holding chamber which serve to introduce the various gases (or liquid methanol) required to produce the desired atmosphere into the four zones 18, 20, 22, 24 and the holding chamber 32.

An endothermic gas generator 55 provides endothermic gas to the four zones 18, 20, 22, 24 and the holding chamber 32 via five gas lines 56, five flow meters 58, and five flow control valves 60 which are coupled to the inlet pipes 46, 48, 50, 52 and 54 via the gas lines 56. A source of natural gas 62, which may be, for example, a public utility main, is also coupled to the inlet pipes 46, 48, 50, 52 and 54 via five gas lines 64, five flow meters 66 and five flow control valves 68. The endothermic gas generator 55 and the natural gas source 62 provide the atmosphere for the furnace 10 when normal carburizing is being performed.

In addition to the endothermic gas generator 55 and natural gas source 62 used in the normal carburization mode of operation, a source of methanol 70, which may be a tank or the like, and a nitrogen source 72, which may be a gas cylinder or the like, provide the atmosphere for the nitrogen-methanol system. The nitrogen-methanol system includes a first stage valving system 92 having a pair of nitrogen flow control valves 74 and 76 as well as a pair of nitrogen flow meters 78 and 80. The valves 74 and 76 and the flow meters 78 and 80 control the total flow of nitrogen through the system. In addition, the valving system 92 has a pair of valves 82 and 84 cooperating with a pair of flow meters 86 and 88 to control the flow of the methanol through the system. The valves 74 and 82 as well as the flow meters 78 and 86 comprise a high flow rate control system, while the valves 76 and 84 and flow meters 80 and 88 comprise a low flow rate control system. Since the methanol in the methanol source 70 is in liquid form, it must be pumped or otherwise fed, for example by gravity, to the valves 82 and 84; however, it has been found convenient to pressurize the methanol tank 70 in order to force the methanol out of the methanol tank without the need for a pump or gravity feed system. The pressurization is accomplished by a pressure regulator 90 which regulates the pressure of the nitrogen from the nitrogen source 72 to a level of, for example, approximately 40 pounds per square inch in order to cause the methanol from the methanol tank 70 to flow at the desired rate. The nitrogen and methanol output from the valves 74, 76, 82 and 84 of the first control panel 92 is applied to a second stage control panel 94 which operates as a second stage valve system for distributing the flow from the first valve system 92 to the various zones. The second stage system 94, in the present embodiment, comprises twenty valves and twenty flow meters, that is one valve and one flow meter for each of the five zones (including holding chamber) of the furnace 10 for each of the high flow rate and low flow rate nitrogen and methanol valves 74, 76, 82 and 84.

In the illustrated system, the high flow rate nitrogen distribution system comprises five flow meters 96 and five flow control valves 98 that are connected to the output of the nitrogen control valves 74 and channel the output of the high flow rate control valve 74 to appropriate ones of the five zones 18, 20, 22, 24 and 32 via five nitrogen distribution pipes 100 which are coupled to the inlet pipes 46, 48, 50, 52 and 54. A similar set of flow meters 102 and flow control valves 104 serves to apply nitrogen from the low flow rate control valve 76 to the zones 18, 20, 22, 24 and 32 via the nitrogen inlet pipes 100.

A similar system is used to control the application of methanol to the various zones 18, 20, 22, 24 and 32. A high flow rate control system utilizing five flow meters 106 and five flow control valves 108 supplies liquid methanol to the various zones 18, 20, 22, 24 and 32 via five methanol lines 110 in accordance with the setting of the various ones of the five flow control valves 108. The five methanol supply pipes 110 are also coupled to the inlet pipes 46, 48, 50, 52 and 54 to inject methanol into the various zones 18, 20, 22, 24 and 32. A similar system including five flow meters 112, five flow control valves 114 is utilized to apply methanol from the low flow rate control valve 84 to the five zones via the methanol lines 110.

Control for the nitrogen-methanol system may be provided manually or by a control system, preferably a microcomputer control system 116, that controls the operation of the various flow control valves 74, 76, 82, 84, 98, 104, 108 and 114 in accordance with input data received from a data terminal 118 and the outputs of the various flow meters 78, 80, 86, 88, 96, 102, 106, 112 and the outputs of one or more sensors such as sensors 121, 123 and 125 that sense the condition of the atmosphere in the various zones. For example, the sensors 121, 123, 125 sense the amount of oxygen in zones 20, 22 and 24, the amount of oxygen being an indication of the carbon potential of the atmosphere within those zones. Since the carbon potential is determined not only by oxygen content, but also by temperature, the oxygen sensors 121, 123 and 125 cooperate with temperature sensors (not shown) in each of the zones to enable the microprocessor control system 116 to calculate the carbon potential for various operating conditions and to readjust the flow of the natural gas or methanol to obtain the required carbon potential that was previously programmed into the system.

In accordance with several important aspects of the present invention, the carburizing furnace 10 is capable of being operated as a normal carburizing furnace operating from an endothermic gas generator such as the generator 55. In this mode, the various valves controlling the flow of methanol and nitrogen from the methanol and nitrogen tanks 70 and 72, respectively, are closed. In the normal carburizing mode utilizing endothermic gas and natural gas, the valves 60, which control the control of endothermic gas and the valves 68, which control the flow of natural gas are set, for example, manually or by the control system, to provide predetermined rates of flow, as indicated by the flow meters 58 and 66. The various flow rates are adjusted as required to generate the desired atmospheres in the various zones in the carburizing furnace 10. Typical flow rates for endothermic gas operation are, for example, 150 standard cubic feet per hour (s.c.f.h.) for Zone 1, 200 s.c.f.h. for Zone 2, 250 s.c.f.h. for Zone 3, 800 s.c.f.h. for Zone 4 and 300 s.c.f.h. for the holding chamber.

In the nitrogen-methanol mode of operation, the valves 74 and 82 control the flow rate of nitrogen and methanol to the various zones. The flow rates provided to the flow control valves 98 by the flow control valves 74 and 82 are approximately the same as the flow rates provided by the endothermic gas generator 55 and natural gas source 62. This is consistent with prior art flow rates for nitrogen-methanol systems, and provides satisfactory carburizing both in the normal carburizing mode and the suspend carburizing mode. However, because of the quantities of methanol and nitrogen used in such carburizing, the cost of carburizing utilizing the nitrogen-methanol system at such flow rates is relatively expensive compared to the cost of endothermic gas carburizing. Accordingly, in accordance with another important aspect of the present invention, it has been found that the flow rate of the carrier gas when the nitrogen-methanol system is being used can be reduced to between 40% to 60% of the flow rate of the flow typically used in an endothermic gas generator system. This is particularly true during the transition from normal to suspend carburizing, during the transition from suspend to normal carburizing and during normal carburizing when the doors 16, 28 and 30 are closed. Such a reduction in flow rate substantially reduces the cost of generating the carburizing atmosphere by the nitrogen-methanol method, and makes the use of suspend carburizing during holiday and weekend periods particularly advantageous.

In order to take advantage of the advantages provided by the high flow rate and low flow rate control system, the position of the doors 14, 30 and 34 is sensed by three door position sensing switches 117, 118 and 120. These door position sensing switches 117, 118 and 120 are coupled to the microprocessor control system via 122, 124 and 126 and indicate to the microprocessor control system 116 whether the doors 14, 30 and 34 are open or closed. In the system according to the present invention, the position of the doors sensed by the sensors 117, 118 and 120 is used to determine whether the nitrogen and methanol are applied to the various zones at the high flow rate or at the low flow rate. For example, whenever a "push" occurs and a new tray is pushed into Zone 1 and another tray exits Zone 4, the doors are opened and permit a substantial amount of the carburizing atmosphere to escape from the various zones, particularly Zones 1 and 4. Therefore, in order to avoid a disruption in the carbon potential of the carburizing atmosphere, the low flow rate valves 70 and 76 are closed, and the high flow rate valves 74 and 82 are opened to assure that any carrier gas that escaped during the "push" is rapidly replenished. The high flow rate is then continued for a predetermined amount of time, for example, five minutes, until equilibrium in the various zones has been established, at which time the valves 74 and 82 are closed and the low flow rate valves 76 and 84 are opened. The low flow rate is continued until the next "push" occurs.

However, it has been determined that while at the high flow rates, satisfactory carburizing has been achieved, at low flow rates, carburizing was less than satisfactory. An investigation indicated that at the low flow rates, the pressure of the atmosphere in the furnace was low and there was insufficient driving force for the gases to move in any particular direction. This resulted in an intermixing of the gases between the zones, particularly between Zones 2 and 3 a condition that did not occur at the high flow rates. Accordingly, the cascaded two stage valve control system was developed to channel the gases from the first stage valving system 92 to the appropriate zones precisely, in order to prevent the mixing of gases between zones thereby maintaining the proper carbon potential within each zone, regardless of the flow rate. The microprocessor maintains the proper carbon potential in each zone by sensing the temperature in the various zones as well as the amount of oxygen present, as sensed by the oxygen sensors 121, 123 and 125. The measured oxygen potential is then compared with an oxygen set point, which varies as a function of temperature, and the position of the valves 68 is automatically adjusted by the microprocessor to obtain the desired oxygen set point, and hence the desired carbon potential.

Although the use of reduced flow rates at various times in the carburizing cycle when the nitrogen-methanol method is used results in a substantial savings in the cost of carburizing compared to systems using the normal nitrogen-methanol flow rates, the cost of carburizing when the nitrogen-methanol method is used is still higher than when the normal endothermic gas process is used. Accordingly, in accordance with another important aspect of the present invention, the nitrogen-methanol system is utilized only when absolutely necessary, that is, only during suspend carburizing and during the transition between normal and suspend carburizing. In normal carburizing, the endothermic gas generator is used to provide the carburizing atmosphere.

Since the use of the nitrogen-methanol system of generating the carrier gas is only necessary during the transition between normal and suspend carburizing which occurs before and after the weekend or holiday period, in a normal work week, nitrogen-methanol need only be used on Mondays and Fridays. Consequently, in a typical week, the system according to the invention is designed to utilize gas from the endothermic gas generator 55 on Tuesdays through Thursdays and nitrogen-methanol on Mondays and Fridays. Thus, in a typical week, the system would be operated from the endothermic gas generator 55 and normal carburizing would occur during the middle of the week. On Friday, the system would be switched to operate as a nitrogen-methanol system under computer control, with the system switching from high flow rates to low flow rates as required, depending on the position of the doors 14, 30, and possibly 34. Near the end of the shift on Friday, the temperature of the furnace 10 is ramped down and the necessary corrections to the carbon potential in the various zones are made by the first stage control system 92 and the various valves in the second stage control system 94. Once the temperature is reduced sufficiently to suspend the carburizing process, the methanol valves 82 and 84 are closed, and the furnace is filled with a nitrogen atmosphere via one of the nitrogen control valves, typically valves 74 and the other valves 98 cooperating therewith.

Following the suspension of carburizing, typically the following Monday, the temperature of the oven 10 is gradually increased and methanol as well as nitrogen is introduced into the furnace in varying quantities in order to obtain the desired carbon potential in each zone. Once normal carburizing is attained, the nitrogen and methanol valves are closed and the endothermic gas valves 60 are opened to permit normal carburizing to proceed.

Obviously modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. In carburizing apparatus of the type utilizing a carburizing furnace having multiple zones, and apparatus for applying nitrogen and methanol to the various zones, the improvement comprising:

first means for controlling the flow rate of the nitrogen and methanol into the furnace, said first means including means for providing a high flow rate to the furnace and for providing a low flow rate to the furnace, and second flow control means cooperating with said first flow control means for distributing the nitrogen and methanol to the various zones of the furnace in varying proportions, said system further including control means responsive to one or more components of the gas composition within the various zones for individually altering the proportions of nitrogen and methanol applied to the various individual zones to obtain a predetermined carbon potential in each zone.

2. Apparatus as recited in claim 1 wherein said control means includes means for sensing the amount of oxygen in the various zones of the furnace and means responsive to said oxygen sensing means for rendering said second flow control means operative to provide various amounts of nitrogen or methanol to said zones to provide predetermined carbon potentials within said individual zones.

3. Apparatus as recited in claim 2 wherein said flow control means is also responsive to the temperature of the various zones.

4. Apparatus as recited in claim 2 wherein said control means includes means responsive to the temperature of the various zones and cooperating with said oxygen sensing means for determining the carbon potential of the zones as a function of temperature and adjusting the flow of nitrogen or methanol to maintain the carbon potential within said zones at a predetermined level as a function of temperature.

5. Apparatus as recited in claim 1 wherein said furnace includes a first set of doors for receiving components to be carburized and a second set of doors for ejecting components that have been carburized, wherein said first flow rate controlling means includes means responsive to the position of said doors for providing said high flow rate when said doors are open and for providing said low flow rate when said doors are closed.

6. Apparatus as recited in claim 5 wherein said flow rate control means includes means for maintaining said high flow rate for a predetermined time interval following the closing of said doors.

7. Apparatus as recited in claim 1 wherein said carburizing apparatus includes means for generating endothermic gas and selector means cooperating with said endothermic gas generating means and for applying either nitrogen and methanol or endothermic gas from said endothermic gas generating means to said various zones.

8. Apparatus as recited in claim 1 further including temperature control means cooperating with said flow rate control means for gradually reducing the temperature of said furnace to a point which carburizing can take place, and applying only nitrogen to said various zones when the temperature is reduced to below where carburizing can take place.

9. Apparatus as recited in claim 8 wherein said temperature control means includes means for gradually increasing the temperature within said zones to a temperature at which carburizing can take place and introducing methanol to said furnace when the temperature is increased to a level at which carburizing can take place.

10. Apparatus as recited in claim 1 wherein said first and second flow control means are connected in cascade, said first flow control means being operative to provide nitrogen and methanol to said second flow control means.

11. Apparatus as recited in claim 10 wherein said first flow control means includes a first nitrogen flow control valve and a first methanol flow control valve.

12. Apparatus as recited in claim 11 wherein said first flow control means includes a second nitrogen flow control valve and a second methanol flow control valve.

13. Apparatus as recited in claim 11 wherein said second flow control means includes a plurality of first nitrogen zone flow control valves each coupled to said first nitrogen flow control valve of said first flow control means and associated with one of said zones, and wherein said second flow control means further includes a plurality of first methanol zone flow control valves each coupled to said first methanol flow control valves of said first flow control means and associated with one of said zones.

14. Apparatus as recited in claim 12 wherein said second flow control means includes a plurality of first nitrogen zone flow control valves each coupled to said first nitrogen flow control valve of said first flow control means and associated with one of said zones, and wherein said second flow control means further includes a plurality of first methanol zone flow control valves each coupled to said first methanol flow control valve of said first flow control means and associated with one of said zones, said second flow control means further including a plurality of second nitrogen zone flow control valves coupled to said second nitrogen flow control valve of said first flow control means and associated with one of said zones, and a plurality of second methanol zone flow control valves each coupled to said second methanol flow control valve of said first flow control means and associated with one of said zones.

15. Apparatus as recited in claim 1 further including exhaust means coupled to said carburizing furnace for exhausting waste gases therefrom, said exhaust means including a pressure sensitive valve responsive to the pressure of the atmosphere within the furnace for altering the flow through said exhaust means to maintain a positive pressure within said furnace.

16. Apparatus as recited in claim 14 wherein said first nitrogen flow control valve is a high flow rate nitrogen flow control valve, said first methanol flow control valve is a high flow rate methanol flow control valve, said second nitrogen flow control valve is a low flow rate nitrogen flow control valve and said second methanol flow control valve is a low flow rate methanol flow control valve.

17. Apparatus as recited in claim 16 wherein said carburizing furnace includes a first door selectively movable between an open and a closed position for receiving into the furnace parts to be carburized, and a second door selectively movable between an open and a closed position for ejecting carburized parts from such furnace, said apparatus further including means for detecting the position of said doors, said control means being responsive to said door position determining means for rendering said high flow rate nitrogen and methanol flow control valves operative when at least one of said doors is in an open position, and for rendering said low flow rate nitrogen and methanol flow control valves operative when said doors are in a closed position.

18. Apparatus as recited in claim 17 wherein the flow rate through the low flow rate control valves is approximately 40 to 60 percent of the flow rate through the high flow rate control valves.

19. Apparatus as recited in claim 17 wherein said control means includes means for maintaining said high flow rate flow control valves operative for a predetermined time interval after said doors have been moved to the closed position.

20. Apparatus as recited in claim 19 wherein said predetermined time interval is on the order of approximately five minutes.

* * * * *